US006223892B1

(12) United States Patent
Bakx

(10) Patent No.: US 6,223,892 B1
(45) Date of Patent: May 1, 2001

(54) ARTICLE CARRIER HAVING BRACE TAB

(75) Inventor: Martinus C. M. Bakx, Goes (NL)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/446,283

(22) PCT Filed: Jul. 2, 1998

(86) PCT No.: PCT/US98/14075

§ 371 Date: Mar. 27, 2000

§ 102(e) Date: Mar. 27, 2000

(87) PCT Pub. No.: WO99/01356

PCT Pub. Date: Jan. 14, 1999

(30) Foreign Application Priority Data

Jul. 2, 1997 (GB) ..... 9713947

(51) Int. Cl.[7] ..... B65D 71/18

(52) U.S. Cl. ..... 206/148

(58) Field of Search ..... 206/140, 141, 206/147–149, 156–158, 434; 294/87.2

(56) References Cited

U.S. PATENT DOCUMENTS

| | | | | |
|---|---|---|---|---|
| 3,767,041 | | 10/1973 | Graser | 206/148 |
| 4,438,843 | * | 3/1984 | Graser | 206/156 |
| 4,566,591 | * | 1/1986 | Turschan et al. | 206/148 |
| 5,598,920 | | 2/1997 | Hansen | 206/148 |

FOREIGN PATENT DOCUMENTS

| | | |
|---|---|---|
| 0 048 506 | 3/1982 | (EP) . |
| 0 541 334 | 5/1993 | (EP) . |
| 1 342 180 | 12/1973 | (GB) . |

* cited by examiner

*Primary Examiner*—Jim Foster
(74) *Attorney, Agent, or Firm*—Thomas A. Boshinski

(57) ABSTRACT

A carton and carton blank for forming a carton of the top gripping type for accommodating a plurality of containers, for example bottles, which carton is tubular in structure and comprises a first panel having a plurality of apertures, each of which has at least one foldable retention tab which operatively engages the underside of the radially protruding part of a container present in the aperture wherein a brace tab is connected to one of said retention tabs and is disposed between a pair of adjacent containers to minimize relative movement between those containers and wherein a free edge of said brace tab operatively engages the underside of the radially protruding part of one of said adjacent containers.

3 Claims, 4 Drawing Sheets

ARTICLE CARRIER HAVING BRACE TAB

BACKGROUND OF THE INVENTION

The invention relates to a carton produced for packaging a plurality of articles, for example bottles. More particularly the invention relates to a carton of the top gripping type which attaches to the tops of the articles thereby securing the articles in an array.

It is known to provide top gripping cartons which comprise so called sunburst apertures having a series of circumferencially arranged tabs which enable the bottle top to pass through the apertures which tabs engage on the underside of a bottle top or on the flange of a bottle neck to prevent the removal of the bottle from the aperture. A problem arises when such sunburst type apertures are used for bottles, in particular the location in which the tab engages the underside of the bottle top is high up on the bottle neck. This creates a carton that is unstable. Further, the tabs are weakened by the unstable nature of the bottles within the carton so reducing its effectiveness.

A further problem is that a top gripping carton needs to be of sufficient strength to support the bottle. A rigid structure would address this problem but produces its own difficulties. In particular, a top panel and/or base panel does not provide requisite rigidity and sufficient strength to support the bottle.

Known cartons of this type are disclosed in EP0541334 A1. This patent specification discloses keel construction suitable for retaining and/or separating articles. However, the keels are somewhat complex to set up from a collapsed form in the carton blank. Several different embodiments of keels are shown and described however, each keel acts to separate two articles in adjacent rows is formed from at least two separate tabs which are struck from the base of the carton which panels are required to be interlocked for example at a co- operating tab and aperture in order to form an erected keel. In some embodiments the base of the carton is formed from two overlapping base panels which are also required to be interlocked and accordingly the formation of the carton and keel structure is fairly complex.

The invention seeks to avoid or at least mitigate these and other problems of the prior art. Positional support is provided to maintain top and base panels in a spaced arrangement while additional strength is provided by multi layering the panels. Therefore the board can be reduced in thickness without reducing the strength needed to hold the bottle.

SUMMARY OF THE INVENTION

Accordingly, in one form of the invention there is provided a carton of the top gripping type for accommodating a plurality of containers, for example bottles, which carton is tubular in structure and comprises a first panel having a plurality of apertures each of which has at least one foldable retention tab which operatively engages the underside of a radially protruding part of a container present in the aperture wherein a brace tab is connected to one of said retention tabs and is disposed between a pair of adjacent containers to minimize relative movement between those containers and wherein a free end edge of said brace tab operatively engages the underside of the radially protruding part of one of said adjacent containers.

According to one optional feature each aperture may be defined by a pair of retention tabs struck from said first panel. The retention tabs of the pair are disposed in positions where they are opposed to each other.

According to another optional feature said brace tab may be placed in a substantially parallel and spaced relationship with the said first panel.

Another aspect of the invention provides a unitary blank for forming a carton of the top gripping type which comprises a first panel having a plurality of apertures each of which has at least one foldable retention tab around each aperture and foldable to stand out of the general plane thereof and a brace tab struck from one of the apertures and hingably connected to one of said retention tabs, the brace tab being foldable out of the plane of the retention tab so that the end edge of the brace tab abuts a retention tab from an adjacent aperture when said carton is set up.

A further aspect of the invention provides a keel structure for separating two adjacent articles and/or retaining said articles in a carton, comprising first and second retention tabs hingably connected to a panel of the carton, said first and second retention tabs respectively engaging the underside of the radially protruding parts of the adjacent articles, wherein said first retention tab comprises a brace tab which extends between the first and second retention tabs to separate and/or retain said adjacent articles.

Preferably, the keel structure resiliently separates two adjacent articles.

DETAILED DESCRIPTION OF THE PREFERRED EMBODIMENT

Figure 1:
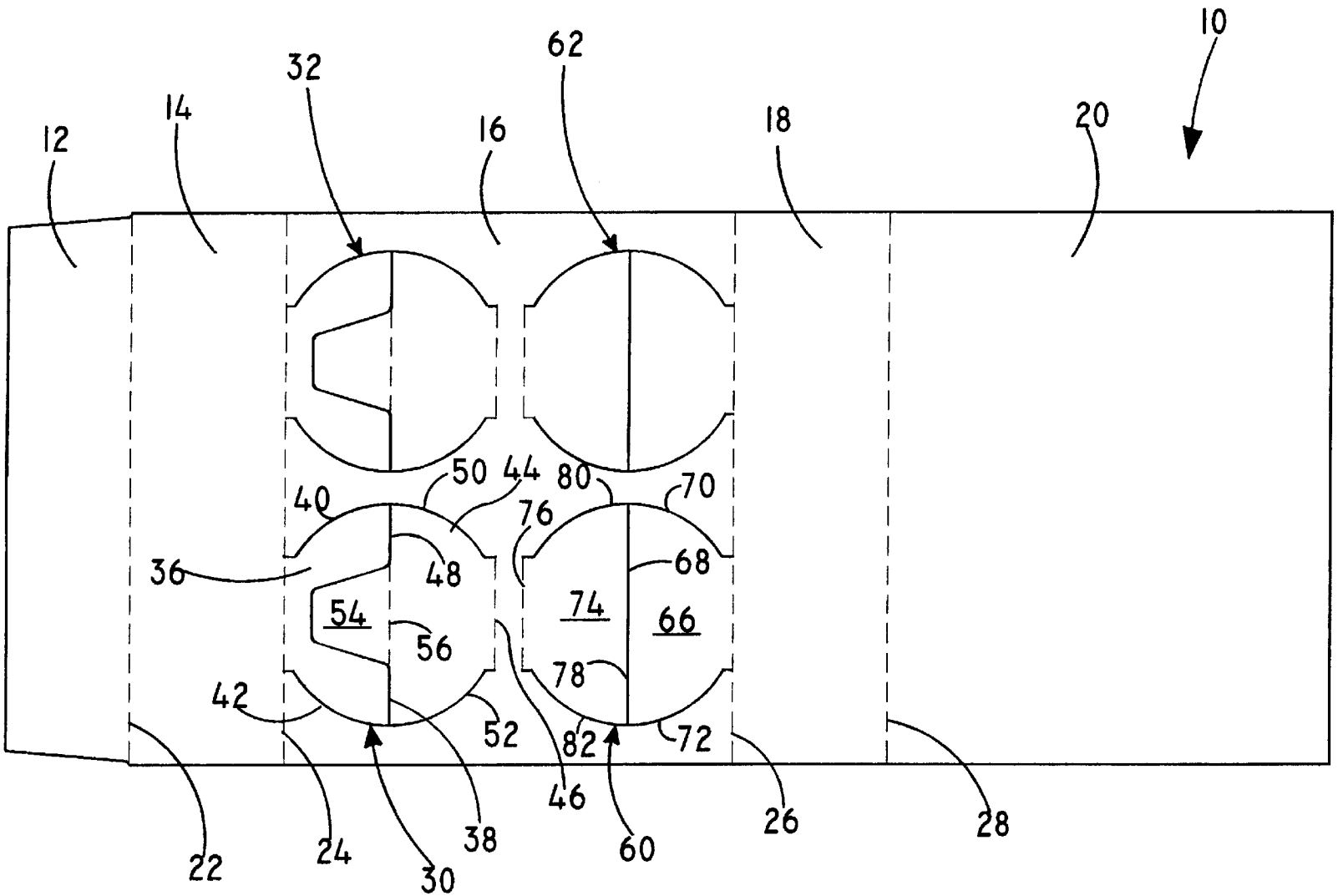
FIG. 1 is a plan view of a carton blank for forming a carton according to the invention.

Referring to the drawings, and in particular FIG. 1 thereof, there is shown a carton blank 10 for forming a top gripping carton made from paper board or similar foldable sheet material. The blank 10 comprises glue flap 12, first side panel 14, base panel 16, second side panel 18, and top panel 20, hingably connected one to the next along fold lines 22, 24, 26 and 28 respectively.

As illustrated in FIG. 1, base panel 16 is formed with two pairs 30 and 32 of retention tabs being struck from base panel 16 adjacent to fold line 24 and laterally spaced intermediate the side edges of base panel 16. Each pair 30 and 32 of retention tabs are struck from base panel 16 to define the pair of article receiving apertures 34 illustrated partially in FIG. 2.

Turning in detail to the configuration of one pair 30 of retention tabs, there comprises retention tab 36 struck from and hingably connected to first side panel 14 along fold line 24. Tab 36 extends inwardly of base panel 16 to its distal edge 38. Tab 36 comprises opposed side edges 40 and 42 which arcuately curve outwardly and diverge from each other toward the distal edge 38 such that the length of the distal edge 38 is greater than the fold line connecting tab 36 to first side panel 14.

A second retention tab 44 is hingably connected to base panel 16 along fold line 46 and is positioned in a central region of base panel 16. In this embodiment, tab 44 is oppositely disposed to tab 36 and extends into aperture 34. In this embodiment, distal edge 48 of tab 44 is juxtaposed to the distal edge 38 of tab 36. Likewise, the side edges 50, 52 of tab 44 arcuately curve outwardly and diverge from each other towards distal edge 48 to provide the distal edge 48 having a greater length than the fold line 46. The curved side edges 40, 42; 50, 52 of tabs 36 and 44 respectively define a substantially circular aperture 34 shown in FIG. 2, when the retention tabs 36, 44 are in a set up condition.

A brace tab 54 is hingably connected to the distal edge 48 of tab 44 along fold line 56. Tab 54 is struck from and extends into retention tab 36. In this embodiment, brace tab 54 is substantially trapezoidal in shape.

Likewise, the second pair 32 of retention tabs is substantially identical in size and configuration to the first pair 30 of retention tabs described above and are not therefore described in any greater detail.

Base panel 16 is also formed with two further pairs 60 and 62 of retention tabs. As illustrated in FIG. 1, the further pairs 60 and 62 of retention tabs are struck from base panel 16 adjacent to fold line 26 and laterally spaced intermediate the side edges of base panel 16. Each pair 60 and 62 of retention tabs are struck from base panel 16 to define the pair of article receiving apertures 64, illustrated partially in FIG. 2.

Turning in detail to the configuration of one pair 60 of retention tabs, there comprises retention tab 66 struck from and hingably connected to second side panel 18 along fold line 26. Tab 66 extends inwardly of base panel 16 to its distal edge 68. Tab 66 comprises opposed side edges 70 and 72 which arcuately curve outwardly and diverge from each other toward the distal edge 68 such that the length of the distal edge 68 is greater than the fold line connecting tab 66 to second side panel 18.

A second retention tab 74 is hingably connected to base panel 16 along fold line 76 and is positioned in a central region of base panel 16. In this embodiment, fold line 76 is in a parallel and spaced relationship with fold line 46 such that retention tabs 44 and 74 are aligned. It is envisaged that such alignment is not necessary in all embodiments. Tab 74 is oppositely disposed to tab 66 and extends into aperture 60. In this embodiment, distal edge 78 is juxtaposed to the distal edge 68 of tab 66. Likewise, the side edges 80, 82 of tab 74 arcuately curve outwardly and diverge from each other towards distal edge 78 to provide the distal edge 78 having a greater length than the fold line 76. The curved side edges 70, 72; 80, 82 of tabs 66 and 74 respectively define a substantially circular aperture 64 shown in FIG. 2, when the tabs 66, 74 are in a set up condition.

The second pair 62 of retention tabs is substantially identical in configuration to the first pair 60 of retention tabs described above and are not therefore described in any greater detail.

It is envisaged that suitable handle means generally known may be provided.

Figure 2:
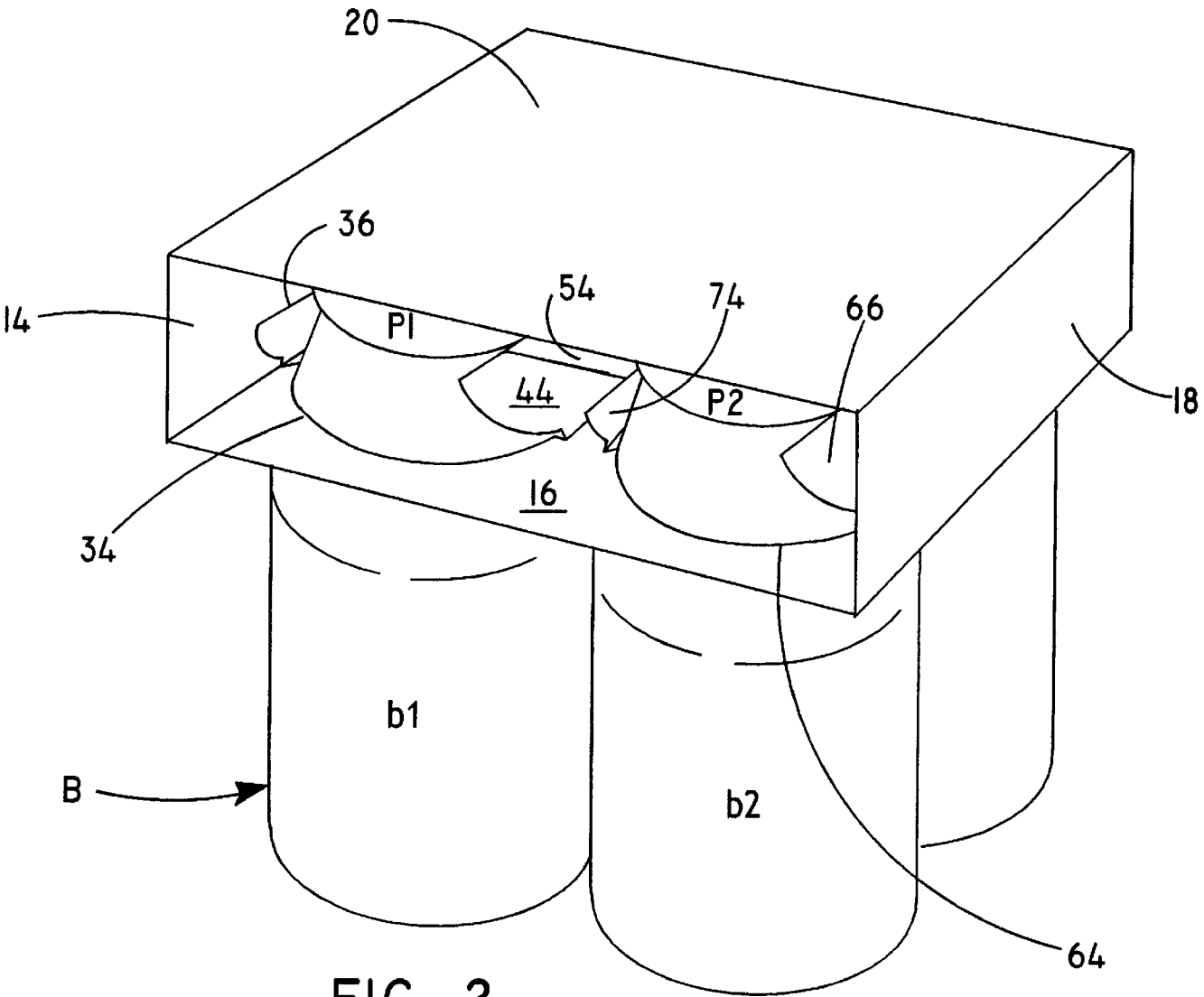
FIG. 2 is a schematic perspective view of a carton formed from a carton blank shown in FIG. 1 according to the invention.
Figure 3:
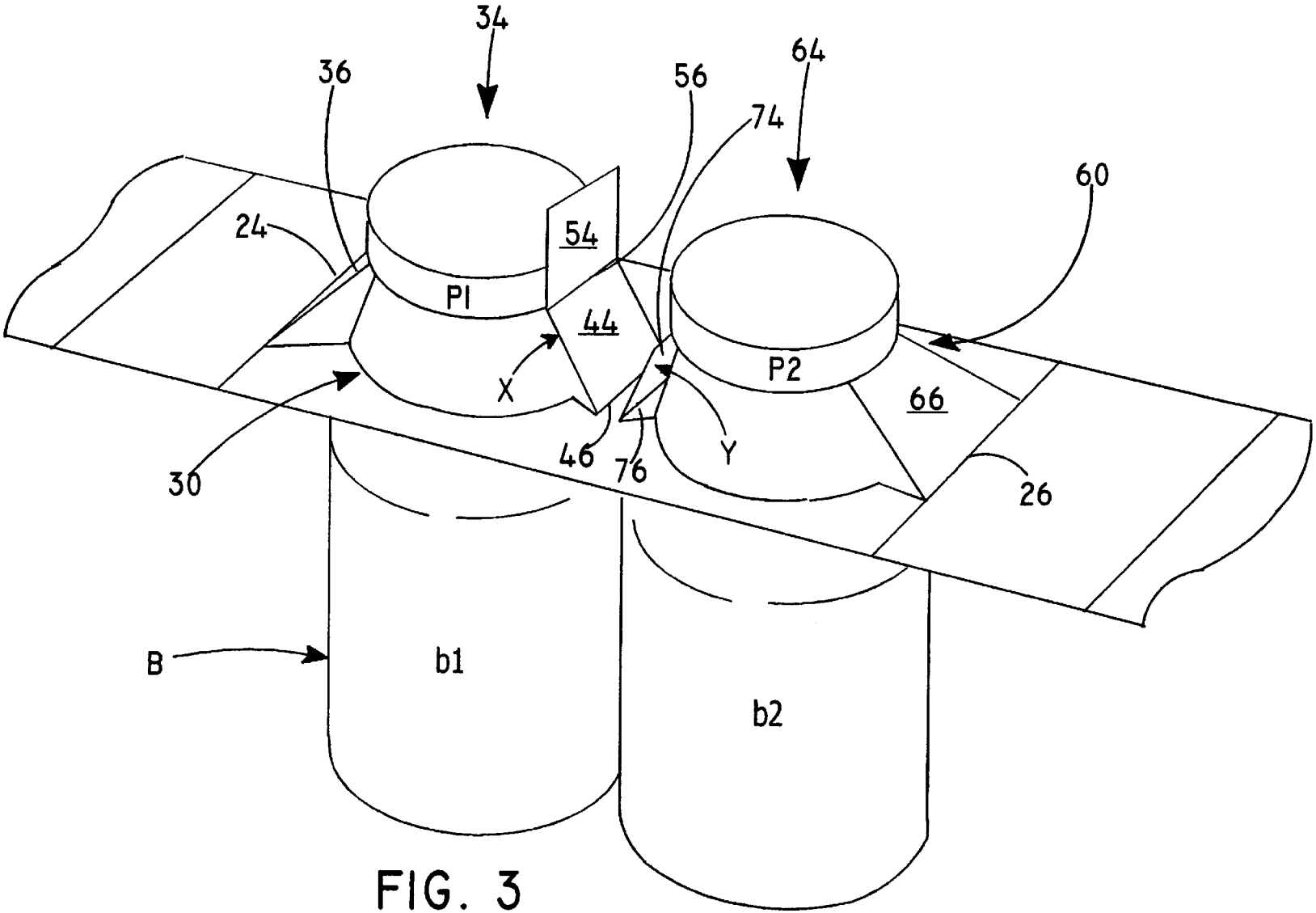
FIGS. 3 and 4 are a schematic perspective representations of two stages in the process of forming a keel structure and part of a carton according to the invention.
Figure 4:
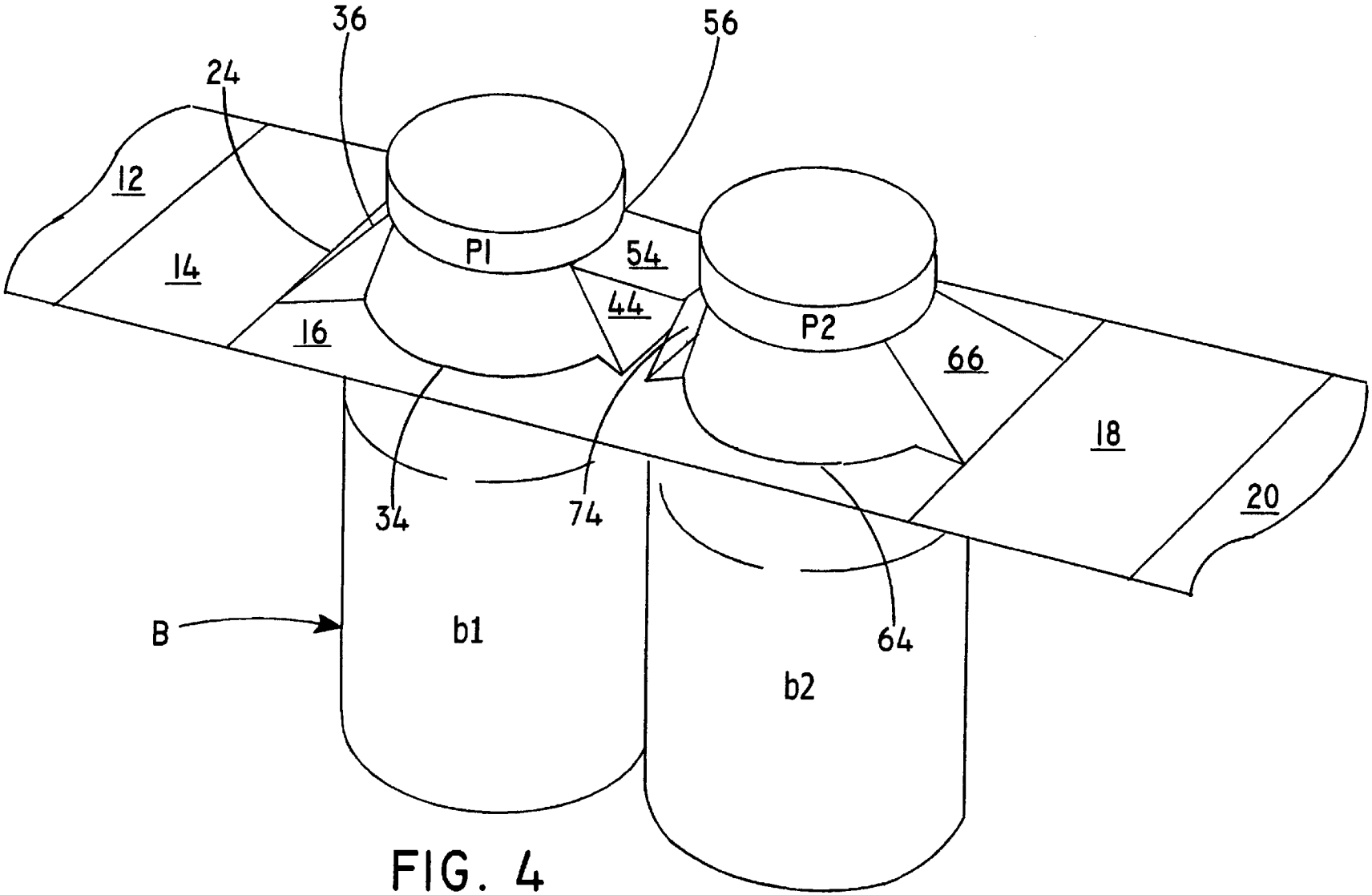

Turning to the construction of the carton as illustrated in FIGS. 2, 3 and 4, the blank 10 requires a series of sequential folding and gluing operations which can be performed in a straight line machine so that the carton is not required to be rotated or inverted to complete its construction. The folding process is not limited to that described below and can be altered according to particular manufacturing requirements.

Thus, bottles B are grouped together in two rows of two bottles b1, b2 and the blank 10 is introduced to the group from above by relative vertical movement between the bottles and the blank 10, preferably during forward feed movement well known in the art. It is envisaged that blank 10 can be adapted to accommodate any number of articles in any number of rows.

FIGS. 3 and 4 show only a section of the carton substantially as hereinbefore described and illustrated in FIGS. 1 and 2, and are included to illustrate the folding process. It is envisaged that the shape of retention tabs and brace tabs is not limited to the type illustrated in FIGS. 1 and 2. Thus, each pair 30 and 60 of retention tabs, shown in FIGS. 3 and 4 are folded along their respective fold lines 24, 46;26, 76 and out of their general plane with respect to base panel 16 to create article receiving apertures 34, 64, shown in FIG. 2. In this embodiment, tabs 44 and 74 are moved inwardly and upwardly in the direction of arrow 'X' and 'Y' respectively and are placed in a substantially upright position, while tabs 36 and 66 are moved outwardly and upwardly and are placed in a substantially upright position. The angle subtended between retention tabs for example 36 or 44 and the associated main carton panel such as base panel 16 is not crucial but is preferably in the region of 60–90°, but of course can be adapted to suit the shape of the packaged article.

As shown in FIG. 3, the bottles b1 and b2 are moved into their respective apertures 34 and 64 until the distal edges 38,; 68,78 of the retention tabs 36,;66,74 respectively come into contact with and are engaged with the underside of the respective protruding portion P1 and P2 of the bottles B associated within each of the apertures 34,64. Optionally, the edge of each article receiving aperture 34,64 is in contact with a neck portion of each of the respective bottles B to provide additional support.

Brace tab 54 is folded backwardly about fold line 56 and placed in an angular relationship with retention tab 44. Thus, distal edge 48 of tab 44 is engaged with the underside of protruding portion P1 of bottle B1. Brace tab 54 extends towards retention tab 74 struck from the opposite aperture 64 and engages the protruding portion P2 of an adjacent bottle b2. Preferably, brace tab 54 is abuts retention tab 74 and serves as a brace between the retention tabs 44 and 74, as shown in FIG. 4.

Thereafter, side panel 14 is folded about fold line 24 into a substantially perpendicular relationship with base panel 16 and glue flap 12 is folded about fold line 22 such that glue flap 12 is in a substantially parallel and spaced relationship with base panel 16. Likewise side panel 18 is folded about fold line 26 into a substantially perpendicular relationship with base panel 16 and top panel 20 is folded about fold line 28 such that the free end portion of top panel 20 is placed in a face to face contacting relationship with glue flap 12. Top panel 20 and glue flap 12 are secured together by glue or other means known in the art. Thus the carton is in a set up condition as shown in FIG. 4.

In use, the brace tabs 54, provide a horizontal brace to better maintain the bottles in their upright position.

The present invention and its preferred embodiments relate to an article carrier which is shaped to provide satisfactory strength to hold bottles securely but with a degree of flexibility so that the load transferred through the retention tabs is absorbed by the carrier. The shape of the blank minimizes the amount of paper that would be required and the carrier can be applied to an array of bottles by hand or automatic machinery. It is anticipated that the invention can be applied to a variety of carrier and not limited to those of the top gripping type.

What is claimed is:

1. A carton of the top gripping type for accommodating a plurality of containers, which carton is tubular in structure and comprises a first panel having a plurality of apertures, each of said apertures including a pair of foldable retention tabs struck from said first panel, said retention tabs of said pair being disposed in respective positions where said retention tabs are opposed to each other, wherein each said retention tab operatively engages the underside of a radially protruding part of a container present in said each aperture, and wherein a brace tab is connected to one of said retention tabs and is disposed between a pair of adjacent containers to minimize relative movement between those containers and wherein an edge of said brace tab operatively engages the underside of a radially protruding part of one of said adjacent containers.

2. The carton according to claim 1 wherein said brace tab is placed in a substantially parallel and spaced relationship with said first panel.

3. A unitary blank for forming a carton of the top gripping type which comprises a first panel having a plurality of apertures, each of said apertures including a pair of foldable retention tabs struck from said first panel, said retention tabs of said pair being disposed in respective positions where said retention tabs are opposed to each other, wherein each said retention tab is foldable to stand out of a general plane of said first panel and operatively engage the underside of a radially protruding part of a container present in said each aperture, and wherein a brace tab is hingably connected to one of said retention tabs and is disposed between a pair of adjacent containers to minimize relative movement between those containers and wherein an edge of said brace tab operatively engages the underside of a radially protruding part of one of said adjacent containers.

* * * * *